US007000730B1

(12) United States Patent
Ostrobrod

(10) Patent No.: US 7,000,730 B1
(45) Date of Patent: Feb. 21, 2006

(54) BEAM ANCHOR

(76) Inventor: Meyer Ostrobrod, 2070 Bennett Rd., Philadelphia, PA (US) 19116

( * ) Notice: Subject to any disclaimer, the term of this patent is extended or adjusted under 35 U.S.C. 154(b) by 83 days.

(21) Appl. No.: 10/246,338

(22) Filed: Sep. 18, 2002

(51) Int. Cl.
*A62B 35/00* (2006.01)

(52) U.S. Cl. ..... 182/36; 182/3; 248/228.1

(58) Field of Classification Search ..... 182/36, 182/3; 248/228.3, 228.5, 228.1
See application file for complete search history.

(56) References Cited

U.S. PATENT DOCUMENTS

| | | | | |
|---|---|---|---|---|
| 1,707,894 | A * | 4/1929 | Bergensen, Sr. | 248/235 |
| 4,052,028 | A * | 10/1977 | Cordero, Jr. | 248/228.1 |
| 4,606,430 | A * | 8/1986 | Roby et al. | 182/3 |
| 5,271,481 | A * | 12/1993 | Rich | 182/3 |
| 5,711,397 | A * | 1/1998 | Flora et al. | 182/3 |
| 6,016,890 | A * | 1/2000 | Whitmer | 182/36 |
| 6,173,809 | B1 * | 1/2001 | Cole et al. | 182/3 |
| D459,839 | S * | 7/2002 | Blackford | D29/124 |

* cited by examiner

*Primary Examiner*—Alvin Chin-Shue
(74) *Attorney, Agent, or Firm*—Norman E. Lehrer

(57) ABSTRACT

A beam anchor safety device for use by workers wearing a lanyard for attachment to the device for preventing falls from elevated locations. The safety device includes an elongate round bar and a pair of L-shaped members affixed to the bar adjacent opposite ends thereof for releasably and slideably connecting the device to a flanged beam. Preferably both of the L-shaped members are moveable along the bar. A lanyard attachment portion is carried by the bar between the L-shaped members and circular washers surround said bar on either side of the lanyard attachment means for rolling engagement with the beam for assisting the sliding of the device along the beam. The elongated bar has a plurality of spaced apart grooves formed in the outer surface thereof and the L-shaped members include means for creating an interference fit with a selected one of the grooves to thereby secure the L-shaped member at a desired position on said bar. In one embodiment, the L-shaped member includes an aperture therein that is adapted to be aligned with a selected one of the grooves and a pin passes through the aperture and lies within the groove to prevent movement of the L-shaped member. In a second embodiment, the L-shaped members include a rotatable element capable of being rotated by a knob between an operative position wherein a portion of the element lies within a groove to create the interference fit and an inoperative position wherein the L-shaped members can be moved along the bar. A spring normally biases the rotatable element into its operative locking position.

10 Claims, 3 Drawing Sheets

BEAM ANCHOR

BACKGROUND OF THE INVENTION

The present invention is directed toward a safety apparatus and more particularly toward a safety apparatus in the form of a beam anchor such as commonly used as a safety device for steel workers and others working on elevated structures. The invention includes a load attachment traversing device that engages an I-beam for movement therealong and which includes a lanyard or the like that can be attached to a harness worn by a workman.

Construction of steel frame structures, such as industrial plants and office buildings, often involves the necessity for steelworkers and other construction personal to work at considerable heights above the ground in order to fasten individual beams and other components together. In such high rise construction, these activities may take place in environments that are subject to wind and weather. In addition, workers may simply stumble or lose their footing are also subject to the mistakes of others on the project site and to the typical construction site hazards of miscommunication or equipment failure that may cause them to fall. As a result, the Occupational Safety and Health Administration ("OSHA") of the United States, and similar agencies in other jurisdictions, have promulgated rules and regulations which require various safety devices to be used by workers who are exposed to the potential of a fall from an elevated structure.

In spite of the numerous devices which have so far been offered to the marketplace, a continuing need exists for a simple, inexpensive device which can be used by steelworkers and similar workmen to provide secure fall protection. The need for such devices is especially seen in conjunction with work where significant freedom of movement is needed to accomplish particular tasks, or where improved productivity can result from additional freedom of movement. As should be readily apparent to those skilled in the art, a device which can provide both additional freedom of movement and assure fall protection would be of great benefit in increasing the productivity on a construction project. To accomplish its desired results, however, such a device must also be easy to use by the workman for whom it is designed to protect.

Devices of the character just described and which provide some of the desired general capabilities have been proposed. These are disclosed, for example, in U.S. Pat. No. 3,217,833 to Smith; U.S. Pat. No. 4,037,824 to Whitmer; U.S. Pat. No. 4,052,028 to Cordero, Jr.; U.S. Pat. No. 4,606,430 to Roby et al.; U.S. Pat. No. 4,767,091 to Cuny; U.S. Pat. No. 5,029,670 to Whitmer and U.S. Pat. No. 5,711,397 to Flora et al.

The safety devices proposed in these prior art patents are of two basic types. First, some devices are fixed at a point of attachment with respect to the steel beam members, such as described in the Whitmer patents. The fixed devices of Whitmer provide a method for securing a safety line to a perimeter cable, but inherently limit the steelworker's speed and mobility due to the necessity of stopping to clip on and off of a fixed line. Second, other types of devices are moveable with respect to the beams to which they are attached, such as shown in the Smith, Cordero, Jr., Roby et al., Cuny and Flora et al. patents.

In Smith, a rigid, elongated, back support bar is utilized. The device highly restricts the workman's ability to move around. Therefore, Smith's device is not believed to be conducive to high productivity. However, the device does provide an adjustable plate and locking pin so that the device can be utilized on beams of various sizes.

In both the Roby et al and Cuny, a rolling clamp device is provided for mounting on a steel track or beam, respectively. These devices are relatively large and it would be difficult to require workmen to carry such a device around a jobsite. Also, both the Roby and Cuny devices utilize an articulating clamp structure which must be properly adjusted and locked in place in order to secure the device. As a result of the articulating structure, both of these devices suffer from the inability to be adjusted for beams of various widths.

Cordero, Jr. proposes a device which is capable of width adjustment for attachment to beams of various sizes. However, his device has many parts and is relatively clumsy to manipulate between beams during the course of a day's work.

Another common deficiency of the above prior art devices is that they are relatively cumbersome to pick up and relocate to new steel beams. The combination of the complexity of operation, the relatively heavy weight, and the orientation requirements of the various prior art devices presents the risk that they will not be used properly or will not be used at all. The device disclosed in Flora et al. attempted to solve some of these problems but still has its limitations. More particularly, the device does not easily slide along the beam as the workman moves. Furthermore, difficulties can be encountered in adjusting the width of the device to fit different size beams.

SUMMARY OF THE INVENTION

The present invention is designed to overcome the deficiencies of the prior art discussed above. It is an object of the present invention to provide a safety device in the form of a beam anchor that is easy to operate.

It is another object of the present invention to provide a beam anchor that more easily slides along the length of the beam in order to follow a workman.

It is a further object of the present invention to provide a beam anchor that can easily be moved from one beam to another.

It is a still further object of the invention to provide a beam anchor that will not malfunction.

In accordance with the illustrative embodiments demonstrating features and advantages of the present invention, there is provided a beam anchor safety device for use by workers wearing a lanyard for attachment to the device for preventing falls from elevated locations. The safety device includes an elongate round bar and first and second L-shaped members affixed to the bar adjacent opposite ends thereof for releasably and slideably connecting the device to a flanged beam. Preferably both of the L-shaped members are moveable along a length of the elongated bar. A lanyard attachment portion is carried by the bar between the L-shaped members and circular washers surround said bar on either side of the lanyard attachment means for rolling engagement with the beam for assisting the sliding of the device along the beam. The elongated bar has a plurality of spaced apart grooves formed in the outer surface thereof and the L-shaped members include means for creating an interference fit with a selected one of the grooves to thereby secure the L-shaped member at a desired position on said bar. In one embodiment, the L-shaped member includes an aperture therein that is adapted to be aligned with a selected one of the grooves and a pin passes through the aperture and lies within the groove to prevent movement of the L-shaped member. In a second embodiment, the L-shaped members include a rotatable element capable of being rotated by a knob between an operative position wherein a portion of the element lies within a groove to create the interference fit and an inoperative position wherein the L-shaped members can be moved along the bar. A spring normally biases the rotatable element into its operative locking position.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
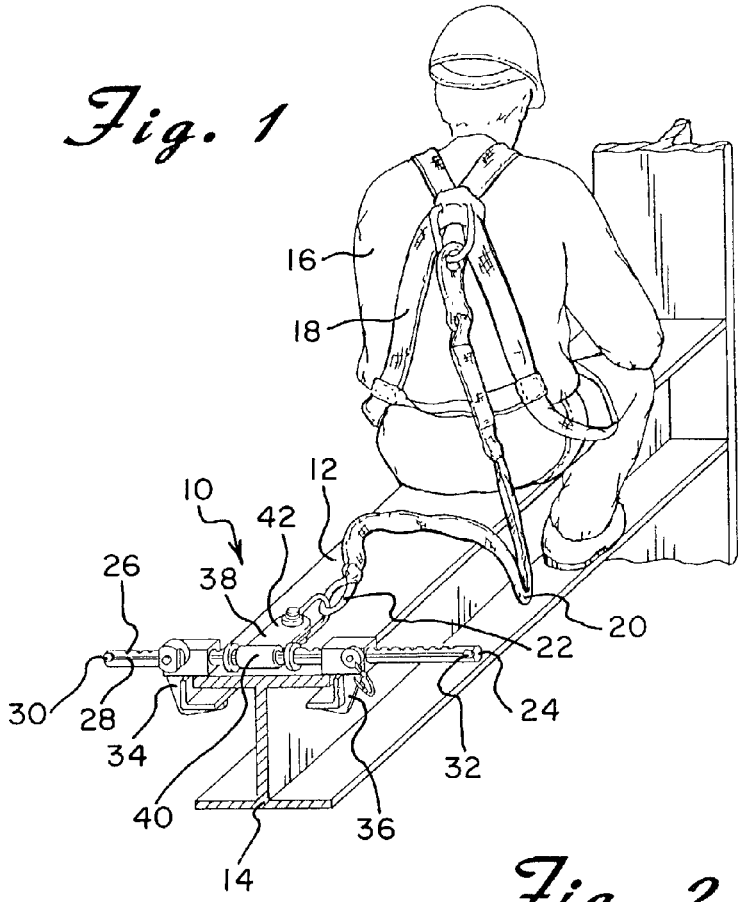
FIG. 1 is a front perspective view showing the overall arrangement of the beam anchor of the invention as installed on an I-beam of a building or other structure and connected to a workman.
Figure 2:
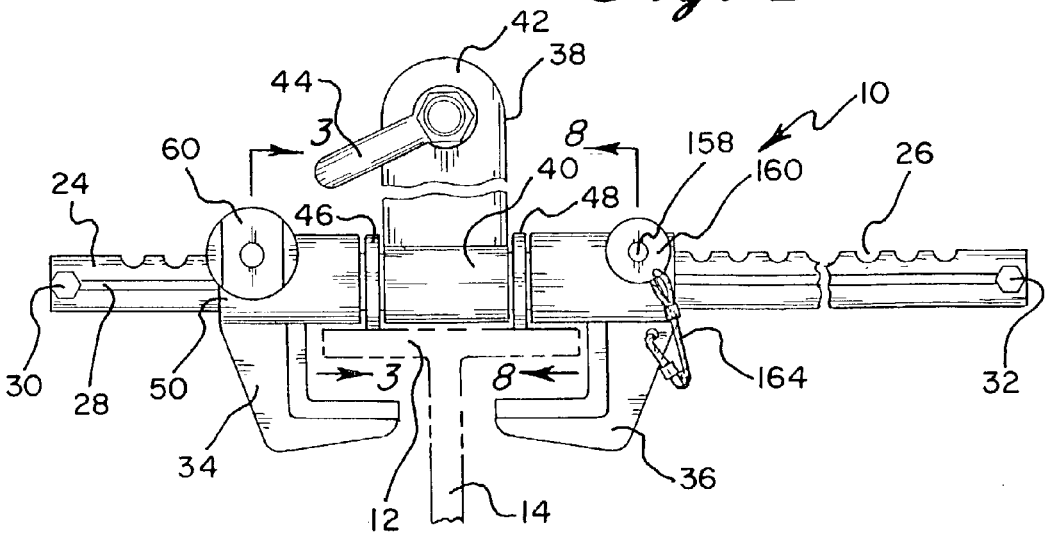
FIG. 2 is an enlarged front elevational view showing the details of the beam anchor of FIG. 1.

Referring now to the drawings in detail wherein like reference numerals have been used throughout the various figures to designate like elements, there is shown in FIGS. 1 and 2 a beam anchor constructed in accordance with the principles of the present invention and designated generally as 10. The beam anchor 10 is shown mounted on the horizontal flange 12 of a beam 14 of a building under construction and, as is well known in the art, is intended to protect a workman 16 from injury due to a fall. The workman 16 is wearing a harness 18 that includes a lanyard 20 connected to the beam anchor 10 through the use of a carabineer 22. As the workman 16 moves, the beam anchor 10 follows him by sliding along the flange 12. All of the foregoing is generally known in the art and has been practiced utilizing prior known devices.

The improved beam anchor 10 of the present invention includes a solid elongated bar 24 which is preferably of circular cross section. Formed in the upper surface of the bar 24 are a plurality of semi-circular grooves such as shown at 26. The grooves may be an inch or so apart from each other and there are preferably sufficient grooves to extend substantially the entire length of the bar 24.

Also formed on the outer surface of the elongated bar 24 is an axially extending groove 28. Groove 28 preferably extends substantially the entire length of the bar 24. Removable stop members 30 and 32 are located at the extreme ends of the elongated bar 24.

First and second L-shaped members 34 and 36 are slideably affixed to the elongated bar 24 so that the position of each of the L-shaped members can be adjusted along at least a substantial portion of the length of the bar 24. In this way, the beam anchor safety device 10 can be connected to the flange 12 of a beam 14 to be slideably connected thereto for use in a manner well known in the art.

FIGS. 1 and 2 show two similar but different embodiments of the left and right L-shaped members 34 and 36. This is, however, for illustration purposes only. It should be understood that the first and second L-shaped members 34 and 36 may both be constructed identically and may both resemble the first L-shaped member 34 or may both resemble the second L-shaped member 36. Furthermore, while, in the preferred embodiment, both of the first and second L-shaped members 34 and 36 are movable along the length of the bar 24, it is possible to practice many of the salient features of the present invention with one of the first or second L-shaped members 34 and 36 being fixed rather than movable as is the case with prior art beam anchors.

Located between the first and second L-shaped members 34 and 36 is a lanyard attachment portion 38. The lanyard attachment portion 38 includes a cylindrically-shaped tubular base 40 that fits around the bar 24 so as to be slideable and rotatable relative thereto. A web 42 extends outwardly from the base 40. A ring 44 is secured to the web 38 to which the lanyard 20 of the workman 16 can be attached.

Located on either side of the base 40 of the lanyard attachment portion 38 is a pair of circular washers 46 and 48. The washers 46 and 48 have center openings that are slightly greater than the circumference of the bar 24 so that the washers are freely rotatable and longitudinally slideable relative to the bar 24. As shown best in FIG. 2, the outer diameters of the washers 46 and 48 are such that they function to support the entire beam anchor 10 on the upper surface of the flange 12. Thus, the washers 46 and 48 are in enrolling engagement with the flange 12 of the beam 14 and assist the beam anchor 10 in sliding more easily along the beam 14 as the workman moves.

The details of the construction and operation of the left L-shaped member 34 are best illustrated in FIGS. 2–7. The L-shaped member 34 includes a base in the form of a rectangularly shaped block 50 having a substantially circular opening 52 passing through the center thereof. The circular opening 52 is slightly greater than the circumference of the bar 24 so that the block 50 can slide along the length of the block. In order to prevent rotation of the block 50 relative to the bar 24, the block includes an inwardly extending key 54 that loosely fits within the groove 28 of the bar 24.

Passing through the upper portion of the block 50 is an aperture 56. The length of aperture 56 is essentially at right angles to the length of the bar 24. A rotatable pin 58 having a manually operable knob 60 extends through the aperture 56 and is held in place by ball detents 62 that prevent the pin from being removed.

Figure 3:
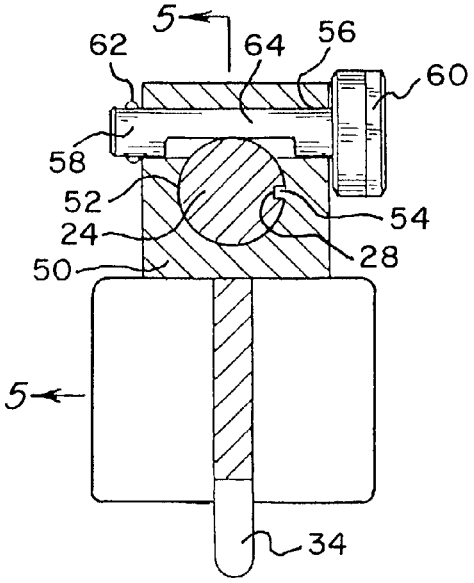
FIG. 3 is a cross-sectional view taken through the line 3—3 of FIG. 2 and showing the locking mechanism in its unlocked position.
Figure 5:
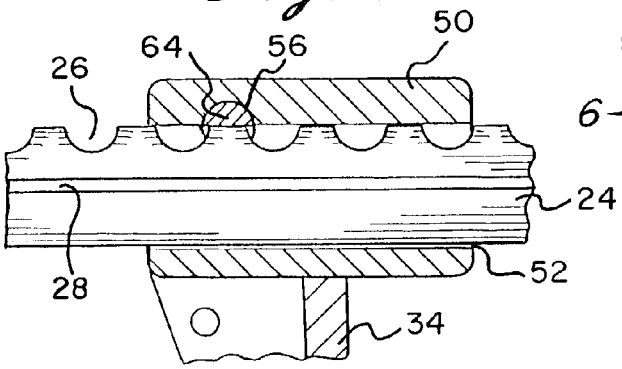
FIG. 5 is a cross-sectional view taken through the line 5—5 of FIG. 3.
Figure 6:
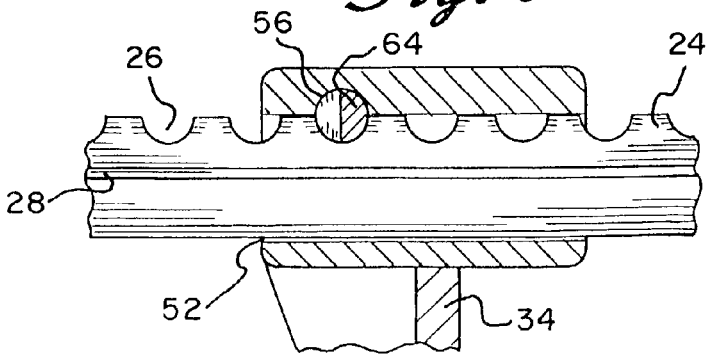
FIG. 6 is a cross-sectional view taken through the line 6—6 of FIG. 4.
Figure 7:
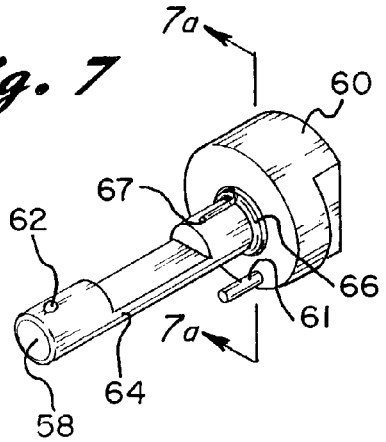
FIG. 7 is a perspective view of the locking mechanism of FIGS. 3–6.
Figure 7A:
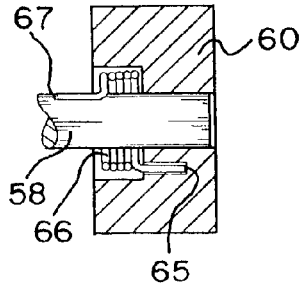
FIG. 7*a* is a cross-sectional view taken through the line 7*a*—7*a* of FIG. 7.
Figure 8:
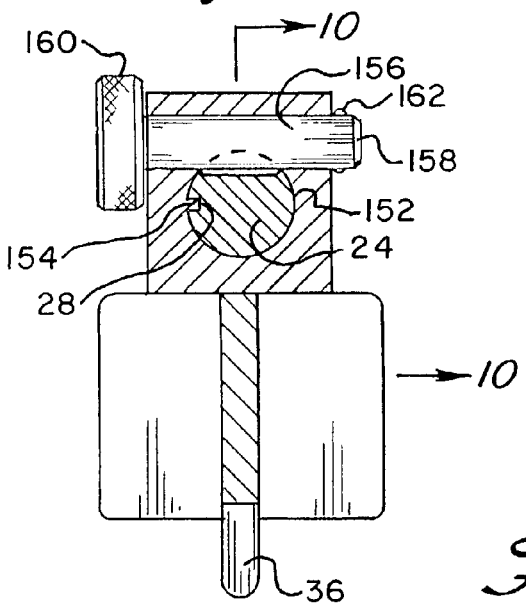
FIG. 8 is a cross-sectional view taken through the line 8—8 of FIG. 2.
Figure 9:
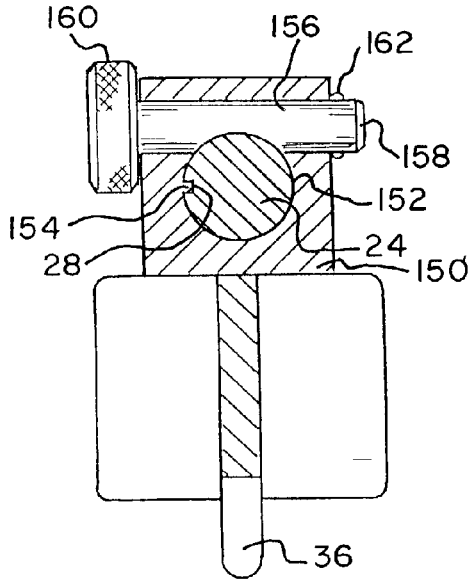
FIG. 9 is a cross-sectional view taken through the line 9—9 of FIG. 2.

The center portion of the pin 58 along a length thereof is cut out as shown best in FIG. 7 so that only a semi-circular portion 64 remains. As illustrated in FIGS. 3–6, when the knob 60 is rotated so that the semi-circular portion 64 is in its inoperative position at the top as shown in FIGS. 3 and 5, it is above the upper surface of the bar 24 so that the block 50 and the entire L-shaped member 34 can easily be slid along the length of the bar 24 into its desired position. When the L-shaped member 34 is in its desired position, the knob 60 is then rotated to its operative position so that the semi-circular portion 64 of the pin 58 moves into one of the grooves 26 to form an interference fit therewith to prevent movement of the L-shaped member 34.

Figure 3A:
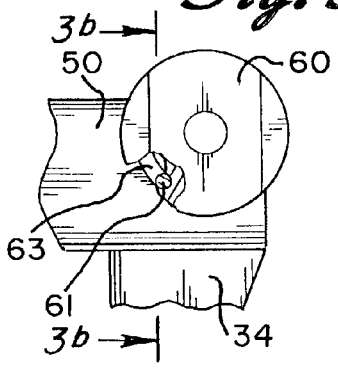
FIG. 3*a* detailed view partially broken away showing the knob used to operate the locking mechanism.
Figure 4:
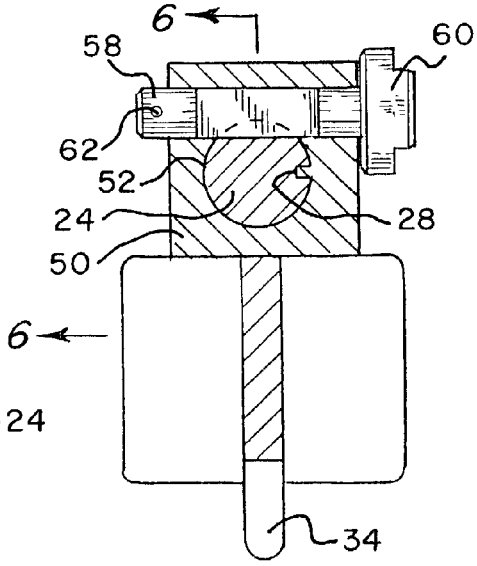
FIG. 4 is a cross-sectional view similar to FIG. 3 but showing the locking mechanism in its locked position.
Figure 3B:
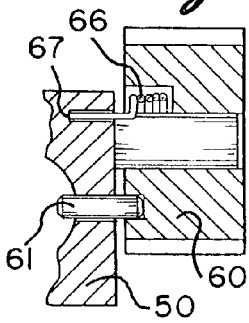
FIG. 3*b* is a cross-sectional view taken through the line 3*b*—3*b* of FIG. 3*a;*

A coil spring 66 having one end 65 connected to the knob 60 and the other end 67 connected to the block 50 biases the pin 58 into the position shown in FIGS. 4 and 6 wherein the semi-circular portion 64 fits within one of the grooves 26. Thus, in actual practice, once the L-shaped member 34 is moved close to its desired position, the workman can release the knob 60 and move the block 50 slightly in either direction until the pin 58 overlies one of the grooves 26. At that point, the pin 58 will automatically rotate so as to place the semi-circular portion 64 into the desired groove 26. The extent of rotational movement of the knob 60 and, therefore, the pin 58 is limited by the projection 61 extending inwardwardly from the inner surface of the knob 60 that rides in the arcuate groove 63 formed in the block 50. See FIGS. 3*a*, 3*b* and 7.

The second L-shaped member 36 is similar to the L-shaped member 34 in that it also includes a substantially rectangularly shaped block 150 having an opening 152 therein which allows the block to slide along the length of the bar 24. The block 150 also includes a projection 154 that is keyed to the elongated slot 28 of the bar 24 to prevent rotation relative thereto.

Figure 10:
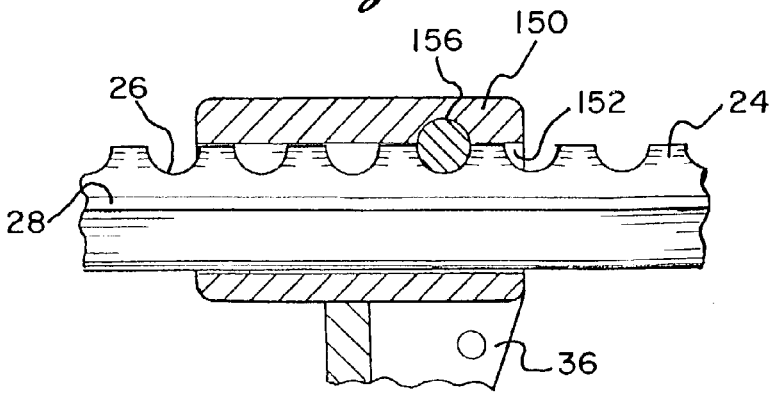
FIG. 10 is a cross-sectional view taken through the line 10—10 of FIG. 8.

Block 150 of the second L-shaped member 36 also includes an aperture 156 extending therethrough. The aperture 156 much like the aperture 56 in the first embodiment intersects the opening 152 so that, when one of the grooves 26 is in alignment with the aperture 156, a circular opening is formed as shown best in FIG. 10. In that position, a locking pin 158 can pass through the aperture 156 and through one of the grooves 56 in the bar 24 to form an interference fit therein so as to prevent movement of the right L-shaped member 36.

The quick release pin 158 is of conventional construction having a head or handle portion 160 and ball detents 162 to retain the pin in place. When it is desired to move the second L-shaped member 36, the pin 158 is removed, the L-shaped member 36 is slid into its desired position and the pin 158 is replaced. As shown in FIG. 2, a retaining wire 164 may be provided to prevent loss of the pin 158 when it is removed.

It is thus to be appreciated that the novel safety device provided by the present invention, and the way in which it is installed and used, is a significant improvement in the state of the art of safety devices for high rise construction activities. The novel safety device is relatively simple, and it substantially improves the efficiency, productivity and safety of workers that utilize the same. It will be readily apparent to the reader that the safety device may be easily adapted to other embodiments incorporating the concepts taught herein. Thus, the invention may be embodied in other specific forms without departing from the spirit or essential characteristics thereof. Therefore, the embodiments presented herein are to be considered in all respects as illustrative and not restrictive, the scope of the invention being indicated by the appended claims rather than by the foregoing description, and all changes and devices which are described within the meaning and range of equivalents of the claims set forth herein are therefore intended to be embraced therein.

I claim:

1. In a beam anchor safety device for use by workers wearing a lanyard for attachment to the device for preventing falls from elevated locations, said safety device of the type that may be releasably and slideably connected to a flanged beam and wherein said device includes an elongate bar and first and second L-shaped members affixed to said bar adjacent opposite ends thereof with at least said first L-shaped member being moveable along a length of said elongated bar, said device further including a lanyard attachment portion carried by said bar intermediate said first and second L-shaped members, the improvement comprising said elongated bar being essentially circular in cross-section and having a plurality of spaced apart grooves formed in the outer surface thereof, said first L-shaped member including an aperture therein adapted to be aligned with a selected one of said grooves and further including a pin adapted to pass through said aperture, said pin having an elongated shaft with first and second ends and a knob located at said first end, a portion of said shaft intermediate said ends being adapted to lie within said groove to prevent movement of said first L-shaped member to thereby secure said first L-shaped member at a desired position on said bar.

2. The improvement as claimed in claim 1 further including means at said second end of said pin for preventing said pin from being removed from said aperture.

3. The improvement as claimed in claim 1 wherein said first entire pin is rotatable between an operative position wherein a portion of shaft lies within said groove to create said interference fit and an inoperative position wherein said first L-shaped member can be moved along said bar.

4. The improvement as claimed in claim 3 further including means for biasing said rotatable pin into its operative position.

5. The improvement as claimed in claim 1 further including roller means coaxially mounted on said bar for rolling engagement with said beam for assisting the sliding of said device along said beam.

6. The improvement as claimed in claim 5 wherein roller means are comprised of circular washers surrounding said bar on either side of said lanyard attachment means.

7. In a beam anchor safety device for use by workers wearing a lanyard for attachment to the device for preventing falls from elevated locations, said safety device of the type that may be releasably and slideably connected to a flanged beam and wherein said device includes an elongate bar that lies above the top surface of said beam and first and second L-shaped members affixed to said bar adjacent opposite ends thereof and a lanyard attachment portion carried by said bar intermediate said first and second L-shaped members, the improvement comprising each of said first and second L-shaped members being slideably affixed to said bar so that the position of each of said L-shaped members can be adjusted along a portion of the length of said bar, said bar being essentially circular in cross-section and including roller means coaxially mounted on said bar for rolling engagement with said top surface of said beam for assisting the sliding of said device along said beam.

8. The improvement as claimed in claim 7 wherein roller means are comprised of circular washers surrounding said bar on either side of said lanyard attachment means.

9. In a beam anchor safety device for use by workers wearing a lanyard for attachment to the device for preventing falls from elevated locations, said safety device of the type that may be releasably and slideably connected to a flanged beam and wherein said device includes an elongate bar that lies above the top surface of said beam and first and second L-shaped members affixed to said bar adjacent opposite ends thereof and a lanyard attachment portion carried by said bar intermediate said first and second L-shaped members, the improvement comprising said bar being essentially circular in cross-section and including roller means coaxially mounted on said bar for rolling engagement with said top surface of said beam for assisting the sliding of said device along said beam.

10. The improvement as claimed in claim 9 wherein roller means are comprised of circular washers surrounding said bar on either side of said lanyard attachment means.

* * * * *